US005248919A

United States Patent [19]

Hanna et al.

[11] Patent Number: 5,248,919

[45] Date of Patent: Sep. 28, 1993

[54] LIGHTING CONTROL DEVICE

[75] Inventors: Robert S. Hanna, Macungie; Donald F. Hausman, Jr., Emmaus; David E. Hougy, Jr., Allentown; Donald R. Mosebrook, Bethlehem; Joel S. Spira, Coopersburg, all of Pa.

[73] Assignee: Lutron Electronics Co., Inc., Coopersburg, Pa.

[21] Appl. No.: 860,921

[22] Filed: Mar. 31, 1992

[51] Int. Cl.[5] ..... H05B 37/02

[52] U.S. Cl. ..... 315/291; 315/292; 315/293; 315/297

[58] Field of Search ..... 315/291, 292, 293, 294, 315/DIG. 4, 307, 297

[56] References Cited

U.S. PATENT DOCUMENTS

| | | | |
|---|---|---|---|
| 4,359,670 | 11/1982 | Hosaka et al. | 315/291 |
| 4,649,323 | 3/1987 | Pearlman et al. | 315/291 |
| 4,924,151 | 5/1990 | D'Aleo et al. | 315/297 |

FOREIGN PATENT DOCUMENTS 2021751 12/1979 United Kingdom .

OTHER PUBLICATIONS

Lightolier® Controls brochure, "Lighting Controls for the 1990's", Brochure No. 27191, Jan. 1991.

Ambiance TM Kliegl brochure, Kliegl Bros. Universal Electric Stage Lighting Co., Inc.

Architectural Dimming Environ®2 brochure, Aug. 1983, Strand Century, Inc.

*Primary Examiner*—Steven Mottola
*Assistant Examiner*—Tan Dinh
*Attorney, Agent, or Firm*—Warren W. Kurz

[57] ABSTRACT

A lighting control device for controlling the state and intensity level of at least one lamp. The device includes a user-actuatable intensity selector for selecting a desired intensity level between a minimum intensity level and a maximum intensity level, a control switch for generating control signals representative of preselected states and intensity levels of the lamp in response to an input, and a control responsive to the intensity selector and the control switch for causing the lamp to fade from an off state to the desired intensity level when the input from a user from a user causes a single switch closure of transitory duration, such fade occurring at a first fade rate, fade from any intensity level to the maximum intensity level when the input from a user comprises two switch closures of transitory duration in rapid succession, such fade occurring at a second fade rate, and fade from the desired intensity level to an off state when the input from a user comprises a single switch closure of more than a transitory duration, such fade occurring at a third fade rate, each of such fade rates being non-instantaneous.

52 Claims, 5 Drawing Sheets

LIGHTING CONTROL DEVICE

FIELD OF THE INVENTION

The present invention relates to devices for operating, switching and controlling the intensity of lighting.

BACKGROUND OF THE INVENTION

Wall-mounted light switches which include a dimmer have become increasingly popular, especially for applications where it is desired to precisely control the level of light intensity in a particular room. Such dimmer switches usually employ a variable resistor which is manipulated by hand to control the switching of a triac which in turn varies the voltage input to the lamp to be dimmed.

This type of dimmer switch is simple and easy to construct, but offers limited flexibility. One feature this type of dimmer switch lacks is the ability to return to a preselected light intensity level after having been turned to full power. This type of dimmer switch has no memory to enable it to do this, however, and preselected light intensity levels established previously can be reestablished only by trial and error in manipulating the variable resistor.

There exist touch actuator controls which address some of the limitations of the manually-operated variable resistor dimmer switches just described. One such touch actuator control cycles repetitively through a range of intensities from dim to bright in response to extended touch inputs. A memory function is provided such that, when the touch input is removed, the cycle will be stopped and the level of light intensity at that point in the cycle will be stored in a memory. A subsequent short touch input will turn the light off, and a further short touch input will turn the light on at the intensity level stored in the memory. While this type of switch is an improvement over manually-operated variable resistor dimmer switches, it requires the user to go through the cycle of intensity levels in order to arrive at a desired intensity level. In addition, it still lacks the ability to return to a desired intensity level after having been set to full light output. A user must go through the cycle again until he or she finds the light intensity level desired. Moreover, this type of switch has no ability to perform certain aesthetic effects such as a gradual fade from one light intensity level to another.

U.S. Pat. No. 4,649,323 discloses a microcomputer-controlled light control which provides a fade function. The control disclosed in that patent is operated by a pair of non-latching switches which provide inputs to a microcomputer. The microcomputer is programmed to determine whether the switches are tapped or held (i.e., whether they are touched for a transitory duration or for a longer period of time). When a switch is held, the light intensity is either decreased or increased, and release of the switch causes the intensity setting to be entered into a memory. If the control is operating at a static light intensity level, a tap of a switch will cause the light intensity level to fade toward a predetermined level, either off, full on or a preset level. A tap while the light intensity level is fading will cause the fade to be terminated and cause the light intensity level to shift immediately and abruptly to either full on or full off, depending on which switch was tapped. This type of control, however, is not without drawbacks of its own. For example, a single tap by a user is interpreted in either of two very different ways (initiate fade or terminate fade), depending on the state of the control at the time the user applies the tap to a switch. This can be confusing to a user, who may erroneously terminate a fade when it is desired to initiate a fade, and vice versa. In addition, it is not possible to reverse a fade by a subsequent tap of the same switch while a fade is in progress. Instead, a tap while the control is fading in one direction will not reverse the direction of the fade but will cause the control to "jump" to either full on or full off. An abrupt shift from a low intensity level to full on, or from a high intensity to no light at all (full off) can be quite startling to the user and others in the area (and even dangerous, if the user and others are suddenly plunged into darkness).

The control disclosed in U.S. Pat. No. 4,649,323 also lacks a long-duration fade to off, as do the other prior control designs. In many cases, it is desirable for a user to be able to have the lights fade out gradually. For example, a user may wish to turn out bedroom lights before retiring, but still have sufficient light to safely make his or her way from the control location to the bed before the lights are completely extinguished. There may also be situations where the night staff of a large building may need to extinguish ambient lights from a central location which is located some distance away from an exit, and may need a gradually decreasing level of illumination in order to walk safely to the exit. These situations would not be possible with the prior control, which would offer the user either almost immediate darkness or a constant level of intensity throughout the night, neither of which would be acceptable.

There is thus a need for an improved lighting control and dimming device which offers advantages not possible with prior controls while avoiding the drawbacks of the prior controls. The present invention fills that need.

SUMMARY OF THE INVENTION

The present invention is directed to a lighting control for controlling the state and intensity level of at least one lamp. The device includes user-actuatable intensity selecting means for selecting a desired intensity level between a minimum intensity level and a maximum intensity level, control switch means for generating control signals representative of preselected states and intensity levels of said at least one lamp in response to an input from a user, and control means responsive to said intensity selecting means and said control switch means for causing said lamp to fade from an off state to the desired intensity level when said input from a user causes a switch closure, said fade occurring at a first fade rate, fade from any intensity level to the maximum intensity level when said input from a user causes two switch closures of transitory duration in rapid succession, said fade occurring at a second fade rate, and fade from the desired intensity level to an off state when said input from a user causes a single switch closure of a transitory duration, said fade occurring at a third fade rate, each of said fade rates being non-instantaneous, or fade from the desired intensity level to an off state when said input from a user causes a single switch closure of more than a transitory duration, said fade occurring at a fourth fade rate.

In one embodiment of the invention, the first, second and third fade rates are equal. In an alternate embodiment, the second fade rate is substantially faster than the first fade rate. In still another embodiment, the fourth fade rate is substantially slower than both the first, second and third fade rates.

The control means may be further responsive to said intensity selecting means for causing said lamp to fade from a first intensity level to a second intensity level at a fifth fade rate when said intensity selecting means is actuated for a period of more than transitory duration.

The invention may further comprise indicator means for visually indicating the intensity level when the lamp is on. The indicator means may comprise a plurality of light sources disposed in a sequence representing a range from the minimum intensity level to the maximum intensity level, the position of each light source within said sequence being representative of an intensity level relative to said minimum and maximum intensity levels. The sequence may, but need not, be linear.

The indicator means may further comprise a plurality of light sources disposed in a sequence representing a range from the minimum intensity level to the maximum intensity level, a selected one of said light sources representing said desired intensity level relative to said minimum and maximum intensity levels being illuminated at a first illumination level and each of the remaining light sources being illuminated at a second illumination level which is less than said first illumination level when said lamp is off. The second illumination level is preferably sufficient to enable said light sources to be readily perceived by eye in a darkened environment. This further plurality of light sources may be the same light sources as the first-mentioned plurality of light sources.

The control means preferably includes a microcomputer means. The microcomputer means may include means for storing in a memory means digital data representative of said fade rates. The microcomputer means may also include means for storing in a memory means digital data representative of a desired intensity level in response to actuation of said intensity selecting means. Further said control means may comprise means for varying the fade rates stored in memory.

In one embodiment of the invention, the intensity selecting means comprises rocker switch means actuatable between first, second and third positions, one of said positions corresponding to an increase in intensity level, the second of said positions corresponding to a decrease in intensity level, and the third being a neutral position. In an alternate embodiment, the intensity selecting means comprises first and second switch means each actuatable between first and second positions, actuation of one of said switch means causing an increase in the desired intensity level and actuation of the other of said switch means causing a decrease in the desired intensity level.

The control means may comprise microcomputer means for distinguishing between an input to said control switch means of transitory duration and an input of more than a transitory duration, and for initiating the fade of said lamp according to an appropriate one of said fade rates as determined by said inputs. In that case, the microcomputer means may include means for storing in a memory means digital data representative of said fade rates.

DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE INVENTION

Figure 1:
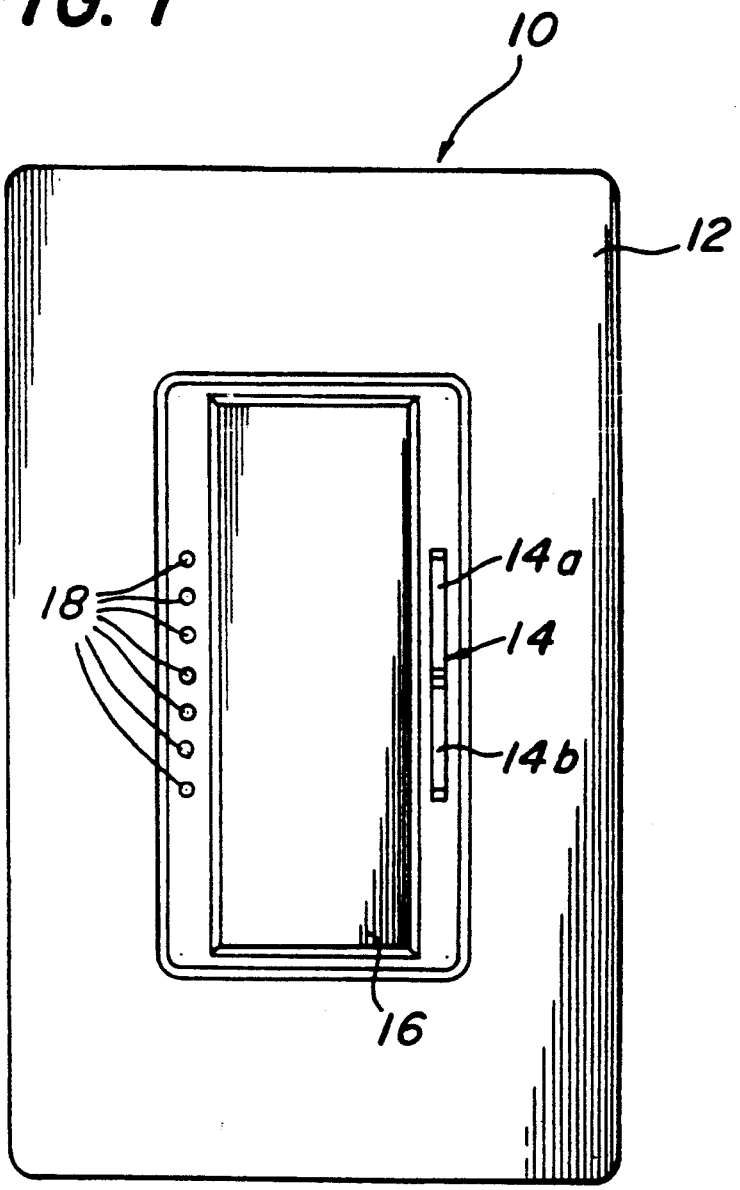
FIG. 1 is a front view of a wall control embodying the lighting control device according to the present invention.

Referring now to the drawings, wherein like numerals indicate like elements, there is shown in FIG. 1 a wall control 10 embodying the lighting control device according to the present invention. Wall control 10 comprises a cover plate 12, intensity selection actuator 14 for selecting a desired level of light intensity of a lamp controlled by the device, and a control switch actuator 16. Cover plate 12 need not be limited to any specific form, and is preferably of a type adapted to be mounted to a conventional wall box commonly used in the installation of lighting control devices. Actuators 14 and 16 likewise are not limited to any specific form, and may be of any suitable design which permits manual actuation by a user. Preferably, although not necessarily, actuator 14 controls a rocker switch, but may also control two separate push switches, for example, without departing from the invention. The switches controlled by actuator 14 may be directly wired into the control circuitry to be described below, or may be linked by an extended wired link, infrared link, radio frequency link, power line carrier link or otherwise to the control circuitry. Likewise, the switch controlled by actuator 16 may also be directly wired into the control circuitry, or linked by an extended wired link, infrared link, radio frequency link, power line carrier link or otherwise to the control circuitry. Preferably, but not necessarily, actuator 16 controls a pushbutton type of switch, but may it be of the touch-sensitive type or any other suitable type. Actuation of the upper portion 14*a* of actuator 14 increases or raises the light intensity level, while actuation of lower portion 14*b* of actuator 14 decreases or lowers the light intensity level.

Wall control 10 includes an intensity level indicator in the form of a plurality of light sources 18. Light sources 18 are preferably, but need not be, light-emitting diodes (LEDS) or the like. Light sources 18 may occasionally be referred to herein as LEDS, but it should be understood that such a reference is for ease of describing the invention and in not intended to limit the invention to any particular type of light source. Light sources 18 are arranged in an array, in this embodiment a linear array, representative of a range of light intensity levels of the lamp or lamps being controlled from a minimum intensity level, preferably the lowest visible intensity (but which may be zero, or "full off") to a maximum intensity level (which is typically "full on"). By illuminating a selected one of light sources 18 depending upon light intensity level, the position of the illuminated light source within the array will provide a visual indication of the light intensity relative to the range when the lamp or lamps being controlled are on. For example, seven LEDs are illustrated in FIG. 1. Illuminating the uppermost LED in the array will give an indication that the light intensity level is at or near maximum. Illuminating the center LED will give an indication that the light intensity level is at about the midpoint of the range. Any convenient number of light sources 18 can be used, and it will be understood that a larger number of light sources in the array will yield a commensurately finer gradation between intensity levels within the range. In addition, when the lamp or lamps being controlled are off, all of the light sources 18 can be constantly illuminated at a low level of illumination, while the LED representative of the present intensity level in the on state is illuminated at a higher illumination level. This enables the light source array to be more readily perceived by the eye in a darkened environment, which assists a user in locating the switch in a dark room, for example, in order to actuate the switch to control the lights in the room, but still provides sufficient contrast between the level-indicating LED and the remaining LEDs to enable a user to perceive the relative intensity level at a glance.

Figure 2:
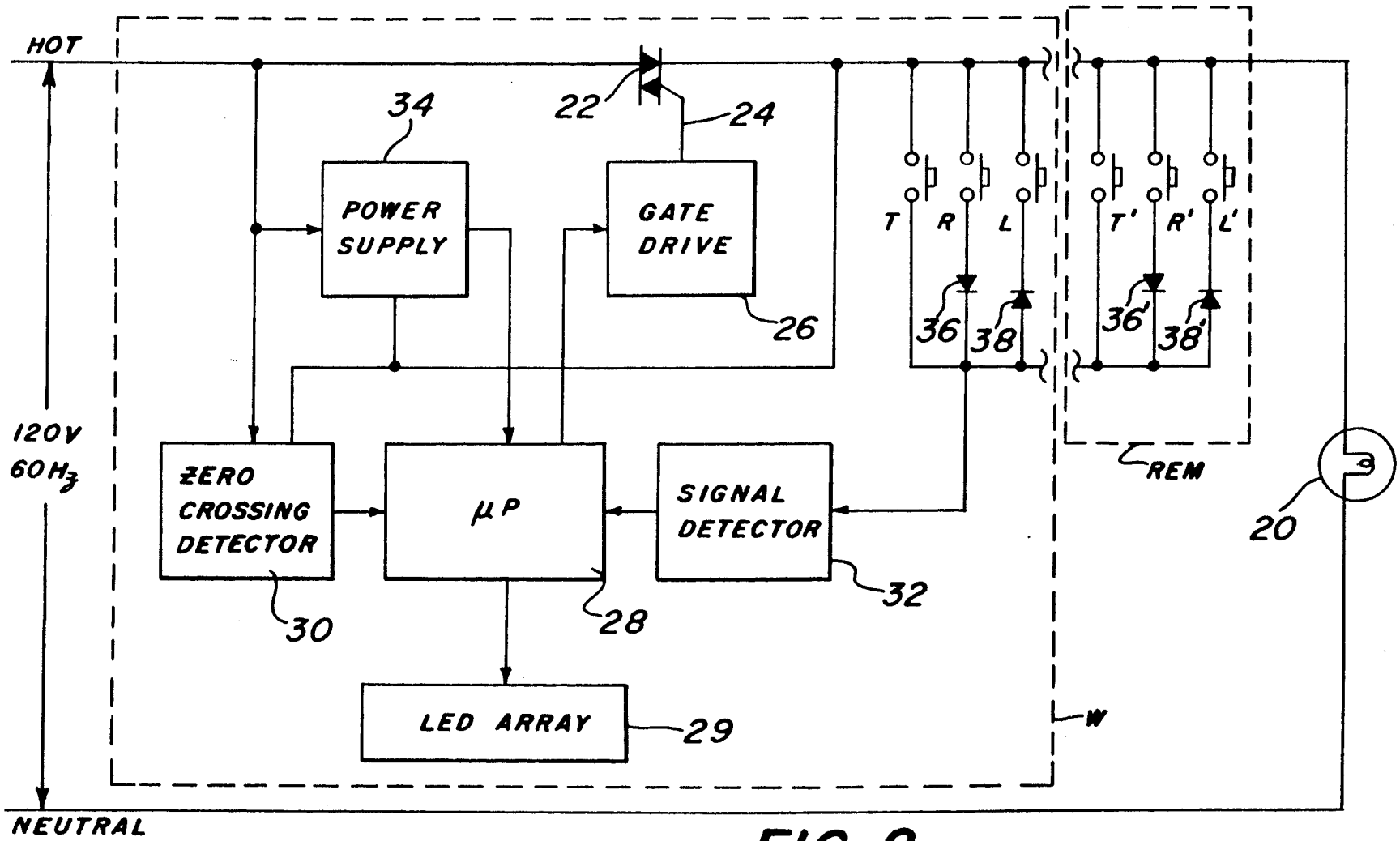
FIG. 2 is a simplified block diagram of a preferred embodiment of the lighting control device according to the invention.

The circuitry of the control device of the present invention is illustrated in the simplified block diagram of FIG. 2. A lamp 20, which may be an incandescent lamp (or lamps) rated between 40 W and several hundred watts, is connected between the HOT and NEUTRAL terminals of a standard source of 120 V, 60 Hz AC power through a thyristor or similar control device 22. A conventional radio frequency interface filter (not shown) comprising a series choke and parallel capacitor can also be included. Thyristor 22 has a control, or gate, input 24 which is connected to a gate drive circuit 26. As those skilled in the art will understand, control inputs on the gate input 24 will render the thyristor conductive or non-conductive, which in turn controls the power supplied to lamp 20. Gate drive circuit 26 provides the control inputs appropriate to the particular thyristor 22 being used in response to command signals from a microcomputer 28. Microcomputer 28 also generates command signals to the array 29 of light sources (labeled "LED ARRAY" in FIG. 2). Inputs to microcomputer 28 are received from zero-crossing detector 30 and signal detector 32. Power to microcomputer 28 is supplied by power supply 34.

Signal detector 32 receives as inputs switch closure signals from switches designated T, R, and L in FIG. 2. Switch T corresponds to the switch controlled by switch actuator 16 in FIG. 1, and switches R and L correspond to the switches controlled by the upper portion a and lower portion b, respectively, of intensity selection actuator 14. Actuators 14 and 16 may be linked to switches T, R and L in any convenient manner.

As will be seen in FIG. 2, closure of switch T will connect the input of signal detector 32 to the dimmed HOT side of the AC supply when triac 22 is nonconducting, and will allow both positive and negative half-cycles of the AC waveform (as referenced to the HOT line) to reach signal detector 32. Closure of switches R and L will also connect the input of signal detector 32 to the dimmed HOT side of the AC supply when triac 22 is nonconducting, but when switch R is closed, only the positive half-cycles of the AC waveform are passed to signal detector 32 because of series diode 36. Series diode 36 is connected with its anode to switch R and its cathode to signal detector 32, so that only positive polarity signals are passed by diode 36. In similar manner, when switch L is closed, only the negative half-cycles of the AC waveform are passed to signal detector 32 because of series diode 38, which is connected so as to allow only negative polarity signals to pass to signal detector 32.

Signal detector 32 detects when, switches T, R, and L are closed, and outputs signals representative of the state of the switches as inputs to microcomputer 28. Signal detector 32 can be any form of conventional circuit for detecting a switch closure and converting it to a form suitable as an input to a microcomputer. Those skilled in the art will understand how to construct signal detector 32 without the need for further explanation herein. Microcomputer 28 determines the duration of closure in response to inputs from signal detector 32.

Zero-crossing detector 30 determines the zero-crossing points of the input 60 Hz AC waveform from the AC power source. The zero-crossing information is provided as an input to microcomputer 28, so that the gate drive commands from microcomputer 28 "gate" the thyristor 22 to provide voltage from the AC power source to lamp 20 at predetermined times relative to the zero-crossing points of the AC waveform. Zero-crossing detector 30 per se is conventional, and need not be described here in further detail. In addition, the timing of the thyristor firing pulses relative to the zero crossings of the AC waveform is also known per se, and need not be described further.

Closure of switch R, such as by a user depressing actuator **14*a*, initiates a preprogrammed "raise light level" routine in microcomputer 28 and causes microcomputer 28 to decrease the length of time between the zero crossing and the firing pulse to thyristor 22 via gate drive circuit 26 in each half cycle. Decreasing the off time increases the amount of time thyristor 22 is conductive, which means that a greater proportion of AC voltage from the AC input is transferred to lamp 20. Thus, the light intensity level of lamp 20 is increased. The off time decreases as long as switch R remains closed. As soon as switch R opens, by the user releasing actuator 14*a*, the routine in the microcomputer is terminated, and the time between the zero crossing and the firing pulse to thyristor 22 is held constant. In a similar manner, closure of switch L initiates a preprogrammed "lower light level" routine in microcomputer 28 and causes microcomputer 28 to increase the time between the zero crossing and the firing pulse to thyristor 22 via gate drive circuit 26. Increasing the off time decreases the amount of time thyristor 22 is conductive, which means that a lesser proportion of AC voltage from the AC input is transferred to lamp 20. Thus, the light intensity level of lamp 20 is decreased. The off time is increased as long as switch L remains closed. As soon as switch L opens, by the user releasing actuator 14*b*, the routine in the microcomputer 28 is terminated, and the time between the zero crossing and the firing pulse to thyristor 22** is held constant.

Switch T is closed in response to actuation of actuator 16, and will remain closed for as long as actuator 16 is depressed by a user. Signal detector 32 provides a signal to microcomputer 28 that switch T has been closed. Microcomputer 28 determines the length of time that switch T has been closed. Microcomputer 28 can discriminate between a closure of switch T which is of only transitory duration and a closure which is of more than a transitory duration. Thus, microcomputer 28 is able to distinguish between a "tap" (a closure of transitory duration) and a "hold" (a closure of more than transitory duration). Microcomputer 28 is also able to determine when switch T is transitorily closed a plurality of times in succession. That is, microcomputer 28 is able to determine the occurrence of two or more taps in quick succession.

Different closures of switch T will result in different effects depending on the state of lamp 20. When lamp 20 is already on at a given preset intensity level, a single tap, i.e., a transitory closure of switch T, will cause a fade to off and two taps in quick succession will initiate a routine in microcomputer 28 which fades the lamp from the preset intensity level to a maximum intensity level at a preprogrammed fade rate. A "hold" of switch T, i.e., a closure of more than a transitory duration, initiates a routine in microcomputer 28 which gradually fades in a predetermined fade rate sequence over an extended period of time from the preset intensity level to off. When lamp 20 is off and microcomputer 28 detects a single tap or a closure of more than transitory duration, however, a preprogrammed routine is initiated in microcomputer 28 which fades the light intensity level of lamp 20 from the off state to a preset desired intensity level at a preprogrammed fade rate. Two taps in quick succession will initiate a routine in microcomputer 28 which fades at a predetermined rate from off to full. The fade rates may all be equal, or they may be different.

All of the previously-described circuitry is preferably contained in a standard wall box, schematically illustrated in FIG. 2 by the dashed outline labelled W. In addition, a further set of switches R', L' and T' and diodes 36' and 38' may be provided in a remote location in a separate wall box, schematically illustrated in FIG. 2 by the second dashed outline, labelled Rem. The action of switches R', L' and T' corresponds to the action of switches R, L and T.

Figure 3:
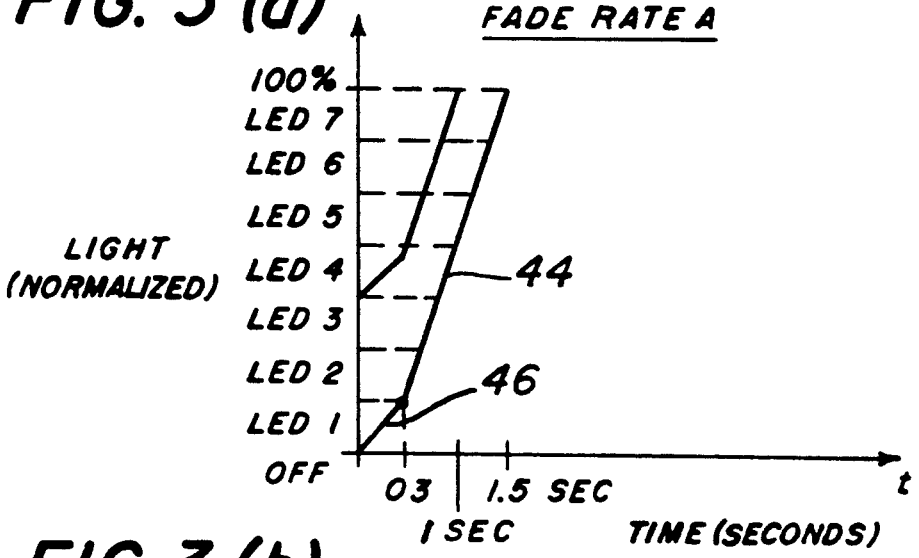
FIG. 3, parts (a) through (d), illustrates the various fade rates and fade rate profiles for the control device.
Figure 3:
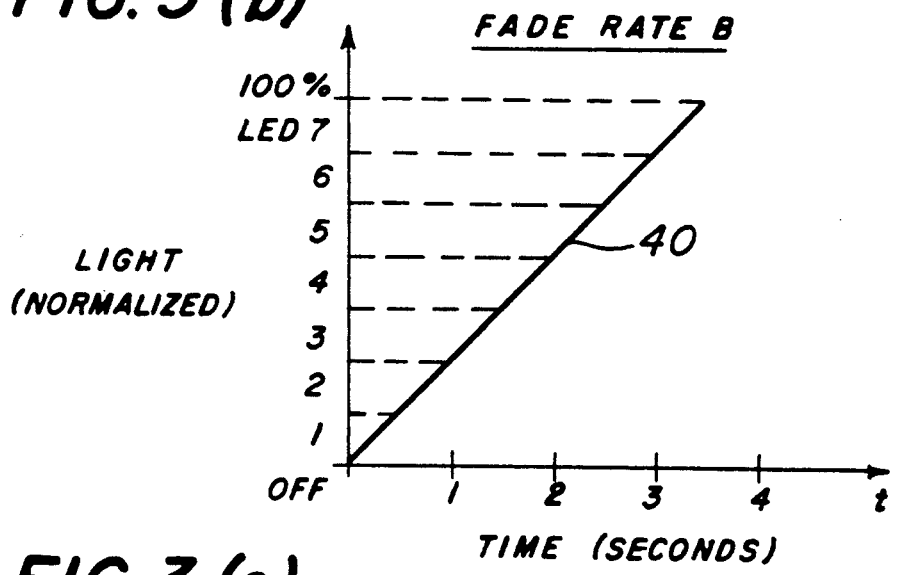
Figure 3:
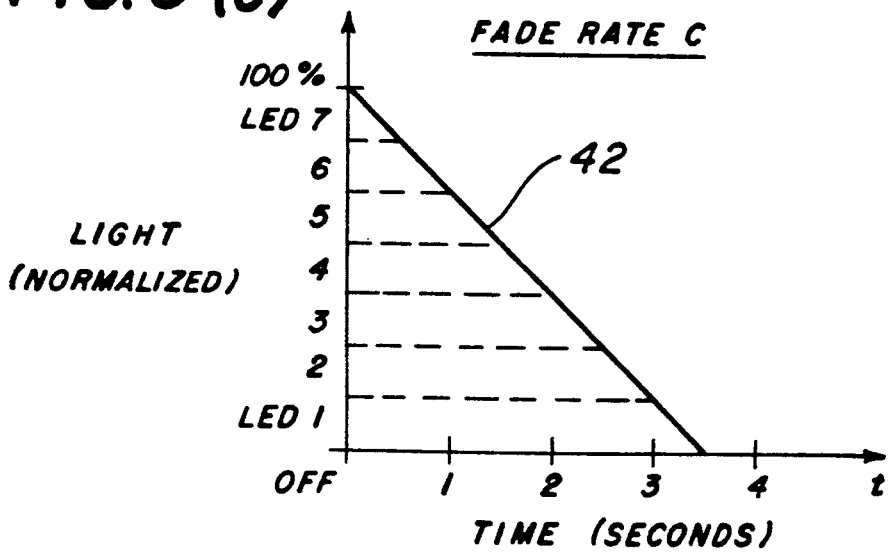
Figure 3:
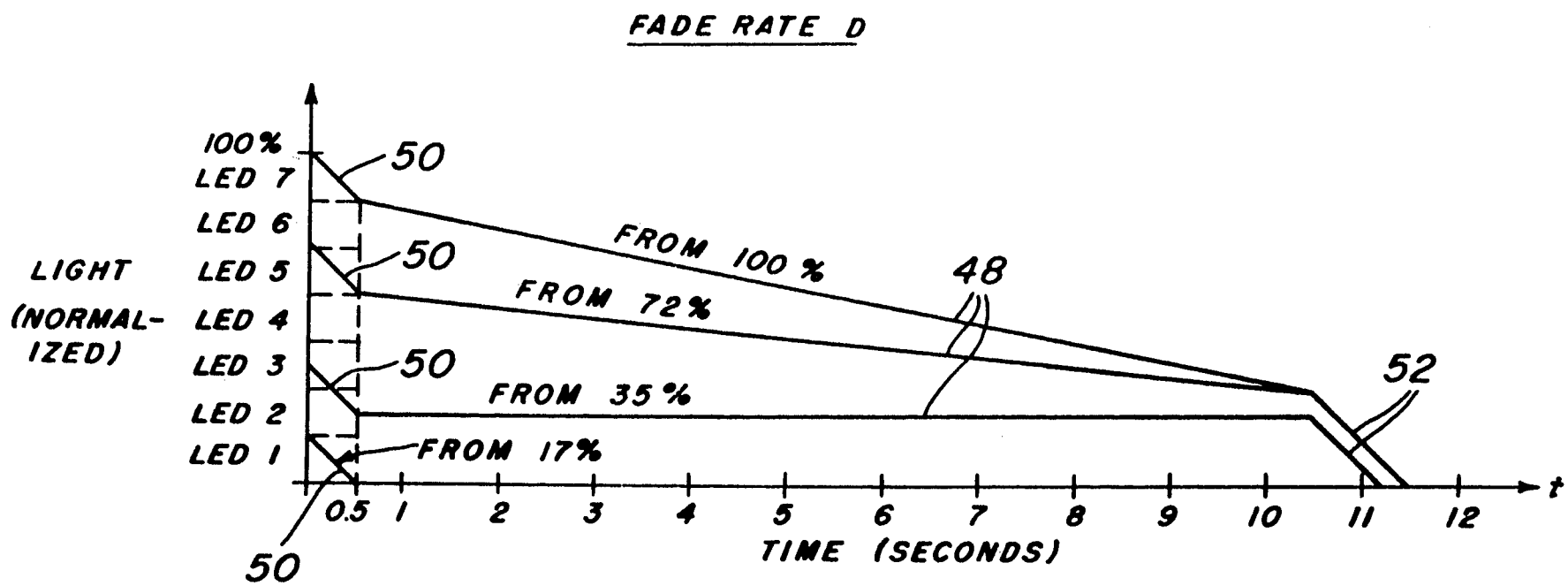

Examples of suitable fade rates and fade rate profiles are illustrated in FIG. 3, parts (a) through (d). Although these fade rates are presently preferred, it should be understood that the illustrated fade rates are not the only ones which may be used with the invention, and any desired fade rate or fade rate profile may be employed without departing from the invention. Part (b) of FIG. 3 illustrates a first fade rate, at which lamp 20 fades up from an off state to a desired intensity level. The first fade rate from "off" to a desired intensity level is labelled with reference numeral 40. Part (b) of FIG. 3 illustrates the fade rate in terms of a graph of normalized light intensity level, from "off" to 100%, v. time, given in seconds. Preferably, fade rate 40 fades from "off" to 100% in about 3.5 seconds, i.e., at the rate of about +30% per second. This fade rate is used when the lighting control device 10 of the invention receives as a user input a single tap of the control switch actuator 16 and the lamp under control was previously off. This fade rate may, but need not, also be used when a user selects a desired intensity level by actuating intensity selection actuator 14. Thus, the lamp 20 will fade up from one intensity level to another at fade rate 40 when upper portion 14*a* of actuator 14 is actuated by the user. Similarly, part (c) of FIG. 3 illustrates a fade rate 42 at which lamp 20 will fade down from one intensity level to another when actuator 16 is tapped when the lamp under control is already on or lower portion 14*b* of actuator 14 is actuated by the user. Fade rate 42 is illustrated as being the same as fade rate 40, but with opposite sign, and fades down from 100% to "off" in about 3.5 seconds, for a fade rate of about 30% per second. However, it will be understood that the precise fade rates are not crucial to the invention, and fade rates 40 and 42 can be different.

Part (a) of FIG. 3 illustrates a second fade rate 44 at which lamp 20 fades up to 100% when the lighting control device 10 receives as a user input two quick taps in succession on control switch actuator 16. As noted above, two quick taps on actuator 16 cause lamp 20 to fade from its then-current light intensity level to 100%, or full on. Fade rate 44 is preferably substantially faster than first fade rate 40, but not so fast as to be substantially instantaneous. A preferred fade rate 44 is about +66% per second, and preferably does not exceed 100% per second. If desired, the fade rate 44 can be initiated after a short time delay, such as 0.3 seconds, or can, in that interval, be preceded by a slower fade rate 46, as shown in part (a) of FIG. 3. This provides a more gradual initiation to the fade up, and is less startling to a user.

A "hold" input at actuator 16 causes lamp 20 to fade from its then-current intensity level to off at a third fade rate 48, as shown in part (d) of FIG. 3. Preferably, fade rate 48 is substantially slower than any of the previously illustrated fade rates. Fade rate 48 is also not constant, but varies depending upon the then-current intensity level of lamp 20. However, the fade rate is preferably always such that the lamp 20 will fade from its then-current intensity level to off in approximately the same amount of time for all initial intensity levels. For example, if lamp 20 is desired to fade to off in about ten seconds (to give the user time to cross a room before the lights are extinguished, for example), a fade rate of about 10% per second will be used if the then-current intensity level of the lamp 20 is 100%. On the other hand, if the then-current intensity level of lamp 20 is only 35%, the fade rate will be only 3.5% per second, so that the lamp 20 will not reach full off until the desired ten seconds. In addition, if desired, a slightly faster fade rate 50 may be used in the initial half-second or so of fadeout, in order to give the user immediate feedback to confirm that the fadeout has been initiated. A suitable fade rate 50 may be on the order of 33% per second. A similarly more rapid fade rate 52 may also be used near the very end of the fadeout, so that the lamp 20 be quickly extinguished after fading to a low level. Thus, after about ten seconds of fadeout, at a relatively slow rate, the lamp 20 will fade the rest of the way to off in about one more second. If the fast initial and final fade rates are used, then the intervening fade rate must be slowed down to achieve the same fade time.

As illustrated in FIG. 3(*d*), with lower initial intensity levels, the intervening fade rate may be zero (constant light output), and with even lower initial intensity levels, the lamp may fade off during the initial fast fade.

Of course, it will be understood by those skilled in the art that any desired fade rates may be used without departing from the invention, and that the numbers use in illustrating the various fade rates is not crucial to the invention.

Preferably, the fade rates are stored in the form of digital data in microcomputer 28, and may be called up from memory when required by preprogrammed fade routines also stored in microcomputer 28. The preprogrammed routines in microcomputer 28 are in themselves not crucial to the present invention. That is, the precise form and structure of the preprogrammed routines may vary depending upon the particular microprocessor used and the fade rates desired. The programming of microcomputer 28 is well within the ordinary skill in the art, and it is not necessary to describe that aspect of the invention in any further detail.

Figure 4:
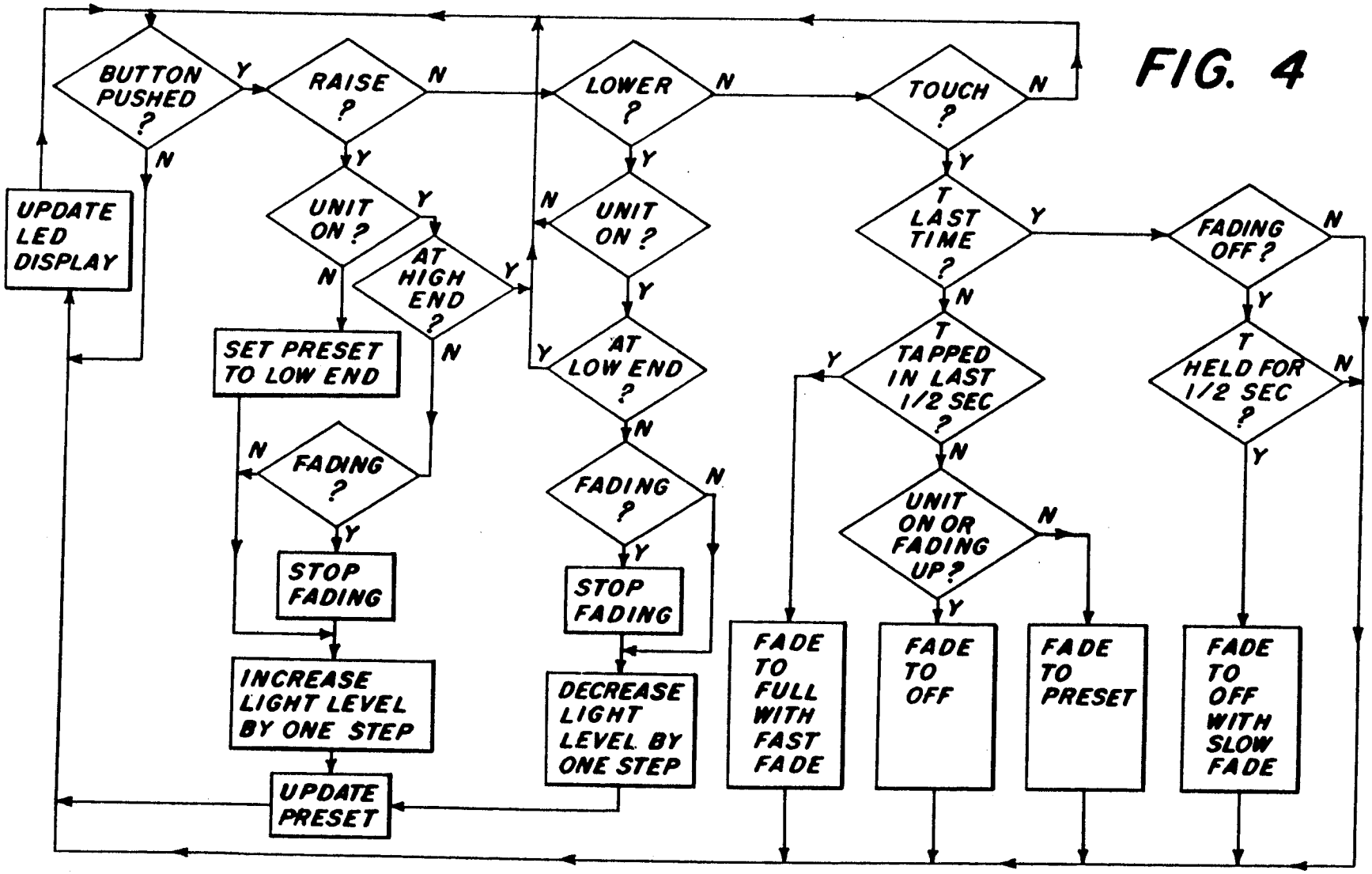
FIG. 4 is a flow diagram showing the operation of the control device according to the invention.

Operation of the preprogrammed routines in microcomputer 28 is illustrated in flow chart form in FIG. 4. Referring to FIG. 4, there are three major flow paths, or routines, which microcomputer 28 can follow, depending on whether switch R, L or T is closed. The first decision node encountered is the "BUTTON PUSHED?" node. If neither actuator 14 or 16 is actuated by a user, no change is made to the state of control device 10 except to update the LED display. However, if the output of the "BUTTON PUSHED?" is a "yes" (Y), then one of the three major routines is initiated. The decision node following the "BUTTON PUSHED?" node is the "RAISE?" decision node. If the output of the "RAISE" decision node is Y (switch R was closed), the routine moves to the "UNIT ON?" decision node. If the control is in the ON state, the output from the "UNIT ON?" decision node is a Y, and the routine next moves to the "AT HIGH END" decision node. If the lamp is at a maximum, no further change is made to control 10. If the lamp is not at a maximum, the routine moves to the "FADING?" decision node. If the unit is then-currently fading from one intensity level to another, i.e., the output of the "FADING?" decision node is Y, the fade is stopped, and the intensity level is incremented by one level step corresponding to the fade rate preprogrammed into microcomputer 28. The slower the fade, the smaller the level stop. The desired intensity level is then stored ("UPDATE PRESET"), and the LED array is updated ("UPDATE LED DISPLAY") to display the raised intensity level by brightly illuminating the appropriate LED. On the other hand, if there is no fade then in progress, i.e., the output of the "FADING?" decision node is N, microcomputer 28 immediately begins to raise the intensity level as above by one level step, update the preset intensity level and update the LED display.

If the control device is in the OFF state, the output from the "UNIT ON?" decision node is N, and the routine sets the intensity level to a minimum and then begins to increase the intensity level as above. Since the control device is in the OFF state, the routine skips the "FADING?" decision node.

If the output of the "BUTTON PUSHED?" decision node is Y and the output of the "RAISE?" decision node is N, the microcomputer 28 moves to the next major routine and enters the "LOWER?" decision node. If the output of the "LOWER?" decision node is Y (switch L was closed), the routine moves to a second "UNIT ON?" decision node. If the control device is in the ON state, the output from the "UNIT ON?" decision node is a Y, and the routine next moves to the next decision node ("AT LOW END?") to determine is the intensity level is already at the minimum. If it is, i.e., the output of the decision node is Y, the routine returns to the starting point and no changes are made in the intensity level. If the output of the "AT LOW END?" decision node is N, however, the routine moves on to the "FADING?" decision node. If the unit is then-currently fading from one intensity level to another, i.e., the output of the "FADING?" decision node is Y, the fade is stopped, and the intensity level is decremented by one level step corresponding to the fade rate preprogrammed into microcomputer 28, to the desired intensity level. The desired intensity level is then stored ("UPDATE PRESET"), and the LED array is updated ("UPDATE LED DISPLAY") to display the lowered intensity level, as already described. On the other hand, if there is no fade then in progress, i.e., the output of the "FADING?" decision node is N, microcomputer 28 immediately begins to lower the intensity level as above by one level step, update the preset intensity level and update the LED display.

If the control device is in the OFF state, the output from the "UNIT ON?" decision node is N, and the routine returns to the starting point.

If the output of the "BUTTON PUSHED?" node is Y, and the outputs of both the "RAISE?" and "LOWER?" nodes is N, the microcomputer 28 enters the third major routine and enters the "TOUCH?" decision node. If the output of that decision node is N, the routine returns to the starting point. If the output is Y, however (switch T was closed), the routine moves to a decision node at which a determination is made as to whether switch T was closed on the previous cycle through the routine. If it was not (N), the routine moves to a decision node at which a determination is made as to whether switch T was tapped in the last half second. If the output is Y, then the output of the control is faded to full light output with the fade rate profile illustrated in FIG. 3(*a*) and the LED display is updated as the fade progresses to display the current intensity level.

If the output from the decision node at which a determination is made as to whether switch T was tapped in the last half second is N, then the routine enters a "UNIT ON OR FADING UP" decision node. If the output from this node is Y, then the output of the control is faded to off with the profile illustrated in FIG. 3(*c*) and the LED display is updated as the fade progresses to illustrate the current intensity level. When the output level reaches zero, the LED display is updated to have all the LEDs on at a much reduced level except the LED which corresponds to the stored preset level which is illuminated at an intermediate level. This provides a nightlight display which enables the unit to be located in the dark and a determination made of the stored preset level.

If the output from the unit on or fading up decision node is N, the output of the control is faded up from off to the stored present level with the fade profile illustrated in FIG. 3(*b*) and the LED display is updated as the fade progresses to illustrate the current intensity level.

If the output from the decision node at which a determination is made as to whether switch T was closed on the previous cycle through the routine was yes (Y), the routine moves to a decision node at which a determination is made as to whether the unit is in the process of fading to off. If the output is N, then no further action is taken except to update the LED display. If the output is Y, the routine moves to a decision node at which a determination is made as to whether switch T bas been held closed for half a second. If the output is N, then no further action is taken except to update the LED display.

If the output is Y, then the output of the control is faded to off with one of the slow fade profiles illustrated in FIG. 3(*d*). The LED is updated as the fade progresses to illustrate the current intensity level and show that the unit is in the slow fade to off mode by flashing the LED corresponding to the instantaneous intensity level. When the output reaches zero, the LED display is updated to have all the LEDs on at a much reduced level except the LED which corresponds to the stored present level which is illuminated at an intermediate level.

Another feature of the invention is that microcomputer 28 may be preprogrammed to illuminate lamp 20 at an intermediate intensity level for a predetermined period when power is restored to lighting control device 10 after a power interruption, and then fade lamp 20 to a very low, but non-zero, intensity level. Prior art devices either do not offer such a feature at all, or illuminate lamp 20 at full power indefinitely when power is restored. Full indefinite illumination of lamp 20 is obviously wasteful of energy, especially if a power interruption/restoration occurs when the user is away from the premises and will not return for an extended period of time. The present invention provides intermediate illumination after power is restored to enable the user to see his way to the lighting control device to reset it to the desired light intensity level set prior to a power interruption. In the event the user is away from the premises for a long time, the fade-to-minimum feature conserves energy and still provides a low level of illumination to enable a user to see in the event illumination from lamp 20 is required when the user returns.

It will be appreciated that the particular matching of a particular control input with a given response is not critical to the invention. For example, microcomputer 28 could be reprogrammed such that a hold input from switch T caused a fade to full and two taps on switch T caused an extended fade to off. Alternatively, the different control inputs to produce the various desired responses, e.g., fade to preset intensity level, fade to full, fade to off and fade to off over an extended period of time, could be provided by separate control switches.

The present invention may be embodied in other specific forms without departing from the spirit or essential attributes thereof and, accordingly, reference should be made to the appended claims, rather than to the foregoing specification, as indicating the scope of the invention.

We claim:

1. A lighting control device for controlling the state and light intensity level of at least one lamp, comprising a) user-actuatable intensity selecting means for selecting a desired intensity level between a minimum intensity level and a maximum intensity level, b) a single control switch, independent of said user-actuatable intensity selecting means, for generating control signals in response to an input from a user, and c) control means operatively coupled to said intensity selecting means and said control switch for causing the lamp intensity to (i) fade from an off state to a desired intensity level when said input from a user causes a single switch closure of transitory duration, said fade occurring at a first fade rate, (ii) fade from any intensity level to said maximum intensity level when said input from a user causes multiple switch closures of transitory duration occurring within a predetermined time interval, said fade occurring at a second fade rate, and (iii) fade from a desired intensity level to an off state when said input from a user causes a single switch closure of more than a transitory duration, said fade occurring at a third fade rate.

2. A device according to claim 1, wherein said first, second and third fade rates are equal.

3. A device according to claim 1, wherein said second fade rate is substantially faster than said first fade rate.

4. A device according to claim 1, wherein said third fade rate is substantially slower than both said first and second fade rates.

5. A device according to claim 1, wherein said control means is further responsive to said intensity selecting means for causing said lamp intensity to fade from a first intensity level to a second intensity level at a fourth fade rate when said intensity selecting means is actuated.

6. A device according to claim 1, further comprising indicator means for visually indicating the desired intensity level.

7. A device according to claim 6, wherein said indicator means comprises a plurality of light sources disposed in a sequence representing a range from said minimum intensity level to said maximum intensity level, the position of each light source within said sequence being representative of an intensity level relative to said minimum and maximum intensity levels.

8. A device according to claim 7, wherein said sequence is linear.

9. A device according to claim 6, wherein said indicator means comprises a plurality of light sources disposed in a sequence representing a range from said minimum intensity level to said maximum intensity level, a selected one of said light sources representing said desired intensity level relative to said minimum and maximum intensity levels being illuminated at a first illumination level and each of the remaining light sources being illuminated at a second illumination level which is less than said first illumination level.

10. A device according to claim 9, wherein said second illumination level is sufficient to enable said light sources to be readily perceived by eye in a darkened environment.

11. A device according to claim 1, wherein the control means includes a microcomputer means.

12. A device according to claim 11, wherein the microcomputer means includes means for storing in a memory means digital data representative of said fade rates.

13. A device according to claim 11, wherein said microcomputer means includes means for storing in a memory means digital data representative of a desired intensity level in response to actuation of said intensity selecting means.

14. A device according to claim 1 wherein said intensity selecting means comprises rocker switch means actuatable between first and second positions, one of said positions corresponding to an increase in intensity level and the other of said positions corresponding to a decrease in intensity level.

15. A device according to claim 1 wherein said intensity selecting means comprises first and second switch means each actuatable between first and second positions, actuation of one of said switch means causing an increase in said desired intensity level and actuation of the other of said switch means causing a decrease in said desired intensity level.

16. A device according to claim 1, wherein said control means further comprises discriminator means for distinguishing between an input to said control switch means of transitory duration and an input of more than a transitory duration.

17. A device according to claim 16, wherein said control means further comprises means responsive to said discriminator means for initiating the fade of said lamp according to an appropriate one of said fade rates as determined by said input.

18. A device according to claim 1, wherein said control means comprises microcomputer means for distinguishing between an input to said control switch means of transitory duration and an input of more than a transitory duration, and for initiating the fade of said lamp according to an appropriate one of said fade rates as determined by said input.

19. A device according to claim 18, wherein said microcomputer means includes means for storing in a memory means digital data representative of said fade rates.

20. A lighting control device for controlling the state and light intensity level of at least one lamp, comprising:

a) user-actuatable intensity selecting means for selecting a desired intensity level between a minimum intensity level and a maximum intensity level, b) a single control switch, independent of said user-actuatable intensity selecting means, for generating control signals in response to an input from a user, and c) control means operatively coupled to said intensity selecting means and said control switch for causing the lamp intensity to (i) fade from an off state to said desired intensity level when said input from a user causes a single switch closure of transitory duration, said fade occurring at a first fade rate, (ii) fade from any intensity level to said maximum intensity level when said input from a user comprises two switch closures of transitory duration in rapid succession, said fade occurring a second fade rate, and (iii) fade from said desired intensity level to an off state when a user touch causes a single switch closure of more than a transitory duration, said fade occurring at a third fade rate, said control means being further responsive to said intensity selecting means for causing said lamp to fade from a first intensity level to a second intensity level at a fourth fade rate when said intensity selecting means is actuated.

21. A device according to claim 20, wherein said second fade rate is substantially faster than said first fade rate, and wherein said third fade rate is substantially slower than both said first and second fade rates.

22. A device according to claim 20, further comprising indicator means for visually indicating the desired intensity level, said indicator means comprising a plurality of light sources disposed in a linear sequence representing a range from said minimum intensity level to said maximum intensity level, the position of each light source within said sequence being representative of an intensity level relative to said minimum and maximum intensity levels, a selected one of said light sources representing said desired intensity level relative to said minimum and maximum intensity levels being illuminated at a first illumination level and each of the remaining light sources being illuminated at a second illumination level which is less than said first illumination level, said second illumination level being sufficient to enable said light sources to be readily perceived by eye in a darkened environment.

23. A device according to claim 20, wherein the control means includes a microcomputer means, the microcomputer means including means for storing in a memory means digital data representative of said fade rates and digital data representative of a desired intensity level in response to actuation of said intensity selecting means.

24. A device according to claim 20, wherein said intensity selecting means comprises rocker switch means actuatable between first and second positions, one of said positions corresponding to an increase in intensity level and the other of said positions corresponding to a decrease in intensity level.

25. A device according to claim 20, wherein said intensity selecting means comprises first and second switch means each actuatable between first and second positions, actuation of one of said switch means causing an increase in said desired intensity level and actuation of the other of said switch means causing a decrease in said desired intensity level.

26. A device according to claim 20, wherein said control means further comprises discriminator means for distinguishing between an input to said control switch means of transitory duration and an input of more than a transitory duration.

27. A device according to claim 26, wherein said control means further comprises means responsive to said discriminator means for initiating the fade of said lamp according to an appropriate one of said fade rates as determined by said input.

28. A device according to claim 20, wherein said control means comprises microcomputer means for distinguishing between an input to said control switch means of transitory duration and an input of more than a transitory duration, and for initiating the fade of said lamp according to an appropriate one of said fade rates as determined by said input, said microcomputer means including means for storing in a memory means digital data representative of said fade rates.

29. A lighting control device for controlling the state and light intensity level of at least one lamp, comprising:

a) user-actuatable intensity selecting means for selecting a desired intensity level between a minimum intensity level and a maximum intensity level, b) a single control switch, independent of said user-actuatable intensity selecting means, for generating control signals representative of on and off states and preselected intensity levels of said at least one lamp in response to an input from a user, and c) control means for causing said lamp intensity to fade from a first intensity level to a second intensity level greater than said first intensity level when said intensity selecting means is actuated, said first intensity level being a minimum intensity level independent of any of said preselected intensity levels when said lamp is in said off state prior to actuation of said intensity selecting means.

30. A device according to claim 29, further comprising indicator means for visually indicating the desired intensity level.

31. A device according to claim 30, wherein said indicator means comprises a plurality of light sources disposed in a sequence representing a range from said minimum intensity level to a maximum intensity level, the position of each light source within said sequence being representative of an intensity level relative to said minimum and maximum intensity levels.

32. A device according to claim 31, wherein said sequence is linear.

33. A device according to claim 30, wherein said indicator means comprises a plurality of light sources disposed in a sequence representing a range from said minimum intensity level to a maximum intensity level, a selected one of said light sources representing said desired intensity level relative to said minimum and maximum intensity levels being illuminated at a first illumination level and each of the remaining light sources being illuminated at a second illumination level which is less than said first illumination level.

34. A device according to claim 33, wherein said second illumination level is sufficient to enable said light sources to be readily perceived by eye in a darkened environment.

35. A device according to claim 29, wherein the control means includes a microcomputer means.

36. A device according to claim 35, wherein said microcomputer means includes means for storing in a memory means digital data representative of a desired intensity level in response to actuation of said intensity selecting means.

37. A device according to claim 29, wherein said intensity selecting means comprises rocker switch means actuatable between first and second positions, one of said positions corresponding to an increase in intensity level and the other of said positions corresponding to a decrease in intensity level.

38. A device according to claim 29, wherein said intensity selecting means comprises first and second switch means each actuatable between first and second positions, actuation of one of said switch means causing an increase in said desired intensity level and actuation of the other of said switch means causing a decrease in said desired intensity level.

39. A lighting control device for controlling the state and light intensity level of at least one lamp, comprising:

(a) user-actuatable intensity selecting means for selecting a desired intensity level of said at least one lamp, (b) control switch means for generating control signals representative of preselected states and intensity levels of said at least one lamp in response to an input from a user, and (c) control means operatively coupled to said intensity selecting means and said control switch means for causing said lamp to fade from a non-zero intensity level to a substantially-zero intensity level at a first fade rate in response to a first input from a user to said control switch means, and for causing said lamp to fade from a non-zero intensity level to a substantially-zero intensity level at a second fade rate, different from said first fade rate in response to a second input from said user to said control switch means.

40. A device according to claim 39, wherein said second fade rate is substantially slower than said first fade rate.

41. A device according to claim 39, wherein said first input from a user comprises closure of a first switch and said second input from a user comprises closure of a second switch.

42. A device according to claim 39, wherein said first input from a user comprises a single switch closure of transitory duration and said second input from a user comprises a single switch closure of more than transitory duration.

43. A device according to claim 39, wherein said first input from a user comprises a single switch closure of transitory duration and said second input from a user comprises two switch closures of transitory duration in rapid succession.

44. In a lighting control device including intensity selecting means for selectively controlling the rate of change current applied to a lamp to cause the lamp intensity to fade from one steady-state intensity level to another, the improvement comprising:

a fade control switch and control means responsive to a control signal produced by a single actuation of said control switch for causing the rate of change of current applied to said lamp to vary in such a manner as to cause the lamp intensity to fade from a first intensity level to a second intensity level in accordance with a fade profile comprising at least first and second fade rates in sequence, said second fade rate being substantially different from said first fade rate.

45. A device according to claim 44, wherein said fade profile comprises first, second and third fade rates in sequence, and wherein the second fade rate is substantially slower than said first and third fade rates, and occurs over a substantially longer time period than said first and third fade rates.

46. A device according to claim 45, wherein said first and third fade rates each occur over time periods of approximately one second, and said second fade rate occurs over a period of approximately ten seconds.

47. A device according to claim 44, wherein said first intensity level is greater than said second intensity level.

48. A device according to claim 44, wherein said first intensity level is less than said second intensity level.

49. A device according to claim 44, further comprising indicator means for indicating when said fade profile is being executed by said fade means.

50. A device according to claim 45, wherein said first, second and third fade rates are adjustable.

51. A device according to claim 45, wherein said second fade rate is substantially zero.

52. A device according to claim 45, wherein said first and third fade rates are approximately equal.

* * * * *